US007733666B2

(12) United States Patent
Ichihara et al.

(10) Patent No.: US 7,733,666 B2
(45) Date of Patent: Jun. 8, 2010

(54) CIRCUIT BOARD STORAGE BAG AND STORAGE RACK

(75) Inventors: Yasuhiro Ichihara, Kawasaki (JP); Shozo Suzuki, Kawasaki (JP); Shoichi Hayashi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 1316 days.

(21) Appl. No.: 11/215,038

(22) Filed: Aug. 31, 2005

(65) Prior Publication Data

US 2007/0007976 A1 Jan. 11, 2007

(30) Foreign Application Priority Data

Jun. 22, 2005 (JP) ..... 2005-181997

(51) Int. Cl.
*H05K 5/00* (2006.01)

(52) U.S. Cl. ..... 361/797; 361/795; 206/706; 206/707; 206/721

(58) Field of Classification Search ..... 361/797, 361/796, 752; 206/307, 308.1, 308.3, 701, 206/706, 720, 721, 707, 708
See application file for complete search history.

(56) References Cited

U.S. PATENT DOCUMENTS 3,554,429 A * 1/1971 Cohen ..... 229/120.34
4,227,237 A * 10/1980 Matthews et al. ..... 361/797
4,426,675 A * 1/1984 Robinson et al. ..... 361/797
4,707,414 A * 11/1987 Long et al. ..... 428/511
4,862,400 A * 8/1989 Selbrede ..... 361/752
5,195,302 A * 3/1993 Collantes et al. ..... 53/442
5,405,000 A * 4/1995 Hagedon et al. ..... 206/216
5,531,328 A * 7/1996 Rochelo et al. ..... 206/706
5,823,352 A * 10/1998 Mena et al. ..... 206/721
6,193,069 B1 * 2/2001 Guenther et al. ..... 206/723
6,381,142 B1 * 4/2002 Hasegawa ..... 361/737
7,400,510 B1 * 7/2008 Milligan et al. ..... 361/752

FOREIGN PATENT DOCUMENTS

JP 10-310128 A 11/1998
JP 11-255332 A 9/1999
JP 2001-119172 A 4/2001

* cited by examiner

*Primary Examiner*—Dameon E Levi
(74) *Attorney, Agent, or Firm*—Arent Fox LLP

(57) ABSTRACT

A circuit board storage bag and a storage rack are disclosed. A plurality of printed circuit board storage bags for accommodating a circuit board comprise a front surface portion and a rear surface portion opposed to the obverse and reverse surfaces, respectively, of the circuit board accommodated in the circuit board storage bag and connecting portions for connecting the front surface portion and the rear surface portion. The front surface portion and the rear surface portion bend at the connecting portions to open and close the circuit board storage bag for use in transporting the circuit board. The circuit boards are stored in a storage rack having an inclined mounting surface for mounting the storage bags and a bag stopper at the lower end of the mounting surface. The bags are stored in vertical position on one side at the lower end of the mounting surface.

6 Claims, 13 Drawing Sheets

CIRCUIT BOARD STORAGE BAG AND STORAGE RACK

CROSS REFERENCE TO RELATED APPLICATION

This application is based upon and claims the benefit of priority from the prior Japanese Patent Application No. 2005-181997, filed on Jun. 22, 2005, the entire contents of which are incorporated herein by reference.

BACKGROUND OF THE INVENTION

1. Field of the Invention

This invention relates to a storage bag, and a box for accommodating the storage bag, used to accommodate and transport electrical circuit boards for electrical devices or electronic circuit boards for the electronic devices or, in particular, to a storage bag, and a box for accommodating the storage bag, used to transport the electrical circuit boards or electronic circuit boards between fabrication or test processes.

2. Description of the Related Art

Generally, the fabrication and assembly of the printed circuit boards of electronic devices such as information equipment and communication devices include a plurality of processes such as the primary assembly line making up the SMT (surface mount technology) assembly process and the secondary assembly line making up the IMT (insert mount technology) assembly process.

In the case where a single printed circuit board is fabricated through a plurality of processes, the printed circuit boards in fabrication process are sequentially charged from one process into next. However, the primary assembly line (SMT assembly process) making up the present process and the secondary assembly line (IMT assembly process) making up the next process may be installed at a distance from each other, e.g. on different floors, due to limited factory space.

In the prior art, to transport the printed circuit board on which the job in the present process has been completed to the next process, a container 91, as shown in FIG. 1, is used. As shown in FIG. 1, the container 91 is partitioned by a plurality of partitioning plates 92 and can accommodate a plurality of (four to eight, for example) printed circuit boards 90 at a time. The printed circuit boards 90 are stored in the container 91 in vertical position in the container 91 for dual purpose of increasing the number of the printed circuit boards to be stored on the one hand and preventing the parts mounted on the surface of the printed circuit boards from being damaged or coming off on the other hand. The size of the container 91, for example, is 400 mm wide by 700 mm long by 500 mm tall, and that of each printed circuit board 90 is 280 mm wide by 390 mm long and 15 mm tall.

SUMMARY OF THE INVENTION

In the prior art, a plurality of printed circuit boards are collectively transported from the present process to the next process using the container 91 as shown in FIG. 1. This is because a great number of the products of the same type are fabricated on the conventional production line and therefore the working efficiency is improved by transporting many circuit boards at a time.

In recent years, however, the industrial structure has so changed that many companies require a multiple-item scant production line. The conventional method in which a plurality of printed circuit boards in fabrication process are transported in a container, therefore, undesirably generates stock in process but not processed immediately to thereby increase the inventory, and, therefore, is no longer desirable for transportation between processes. The stock of extraneous products in process poses the problem that the lead time, before product completion from charge into the production line, is lengthened.

Further, the container has the size described above and requires a considerable space even in the case where only one circuit board is stored. Another problem is that, in the case where the containers are stacked to save the installation space, the wasteful job of removing the stacked containers is generated to recover an intended one of the printed circuit boards stored in one of the containers. Further, the containers transported later from the preceding process are stacked on the containers transported earlier from the preceding process, thereby making it difficult to manage the circuit boards on first-in first-out basis.

The object of this invention is to provide a bag for storing and transporting printed circuit boards, in which the problem described above is obviated by reducing the stock of the printed circuit boards in process between different steps.

Another object of the invention is to provide a storage rack, for accommodating the storage bags described above, in which the installation space is saved for storing the printed circuit boards transported by the storage bags and the printed circuit boards in stock can be easily delivered inward and outward.

In order to achieve these objects, according to the invention, there are provided circuit board storage bags each adapted to accommodate one printed circuit board to be transported and a storage rack capable of accommodating the bags in line.

Specifically, according to one aspect of the invention, there is provided a circuit board storage bag, for accommodating a single circuit board, comprising a front surface portion and a rear surface portion opposed to the obverse and reverse surfaces, respectively, of the circuit board accommodated in the circuit board storage bag in closed state, and a connecting portion for connecting the front surface portion and the rear surface portion adapted to be bent at the connecting portion thereby to close the circuit board storage bag.

According to another aspect of the invention, there is provided a storage rack for storing the circuit board storage bags, comprising an inclined mounting surface on which the circuit board storage bags are mounted, and a bag stopper arranged at the lower end of the mounting surface, wherein the circuit board storage bags placed vertically on the mounting surface are accommodated on one side at the lower end of the mounting surface.

According to still another aspect of the invention, there is provided a storage rack for mounting the circuit board storage bags, comprising means for storing a plurality of circuit board storage bags stacked in a predetermined direction, a circuit board storage bag inward delivery port open in the direction perpendicular to the predetermined direction, and a circuit board storage bag outward delivery port open to the direction perpendicular to the predetermined direction.

BRIEF DESCRIPTION OF THE DRAWINGS

The present invention will be more clearly understood from the description, as set forth below, with reference to the accompanying drawings, in which.

DESCRIPTION OF THE PREFERRED EMBODIMENTS

Figure 1:
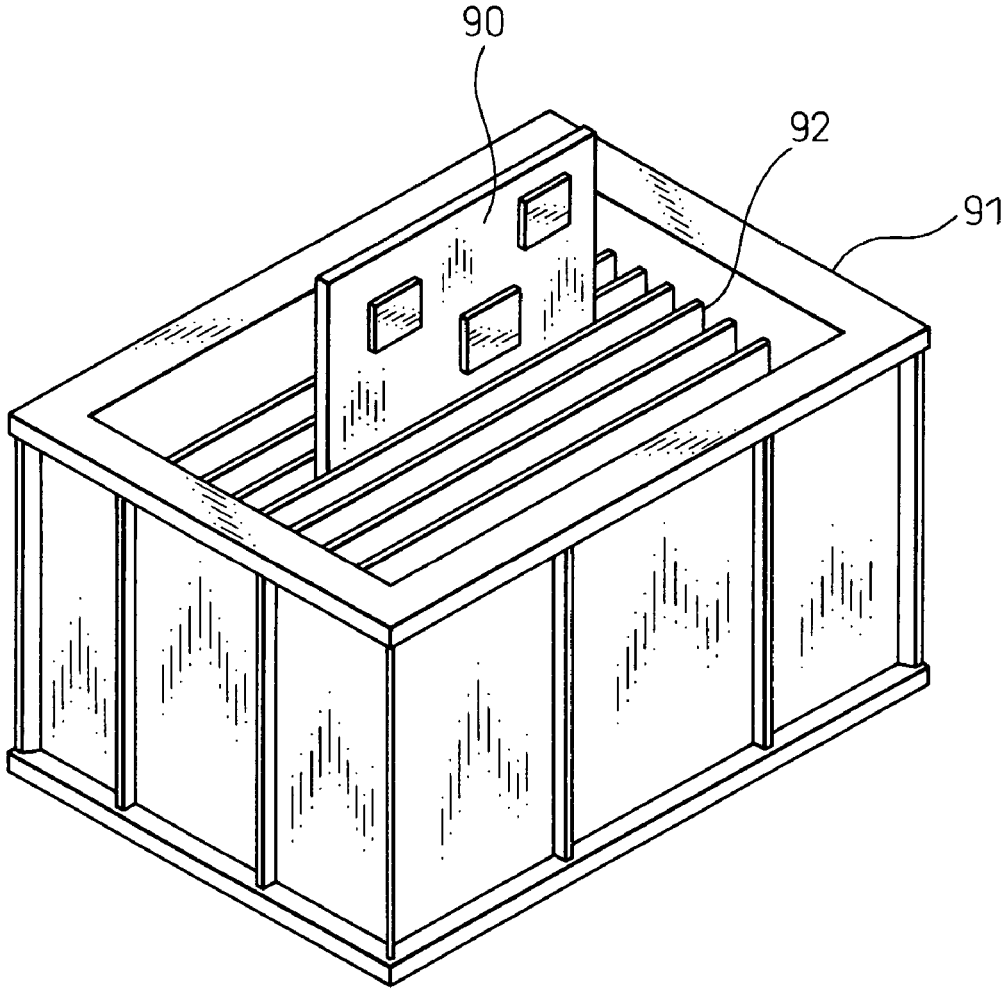
FIG. 1 is a perspective view showing a container conventionally used for transportation of the printed circuit boards.
Figure 2A:
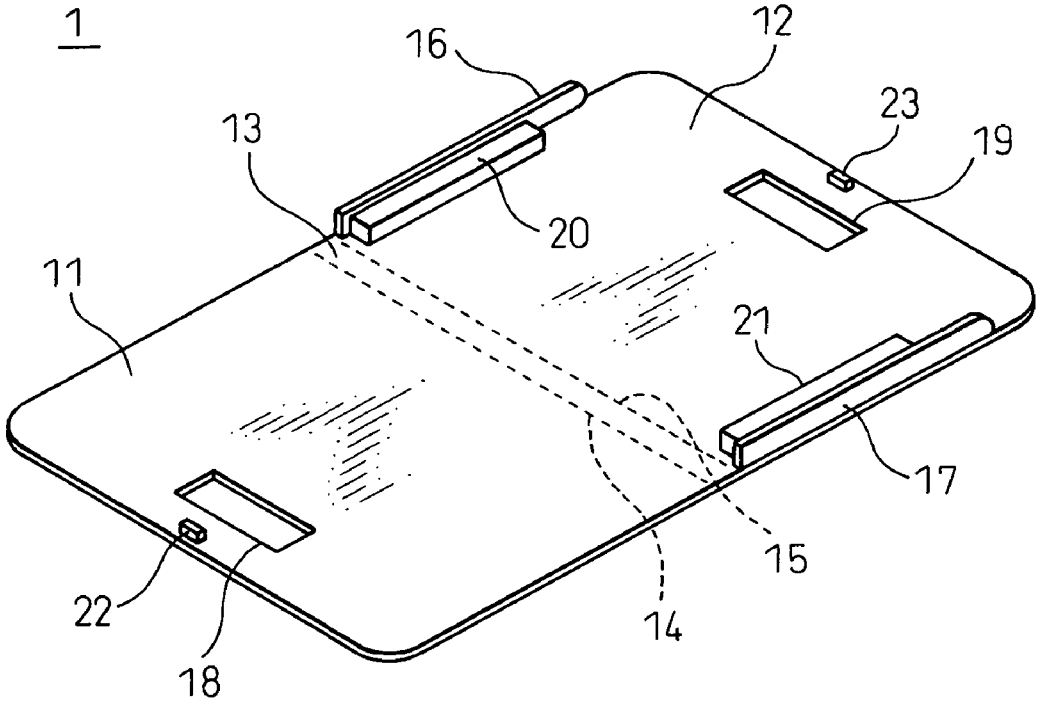
FIG. 2A is a perspective view showing the basic configuration of a circuit board storage bag in open state according to the invention.

The basic configuration of the circuit board storage bag and the storage rack for the circuit board storage bags according to the invention is explained below with reference to the accompanying drawings of FIGS. 2A, 2B, 3 to 5. FIG. 2A is a perspective view showing the open state of the circuit board storage bag according to the invention.

As shown in FIG. 2A, the circuit board storage bag 1 includes a front surface portion 11 making up the front surface of the bag 1 in closed state, a rear surface portion 12 making up the rear surface of the bag 1, a bottom surface portion 13 making up the bottom surface of the bag 1, and side surface portions 16, 17 making up the side surfaces of the bag 1.

The front surface portion 11 and the bottom surface portion 13 are connected to a first connecting portion 14 adapted to bend, and the rear surface portion 12 and the bottom surface portion 13 are connected to each other through a second connecting portion 15 adapted to bend.

Figure 2B:
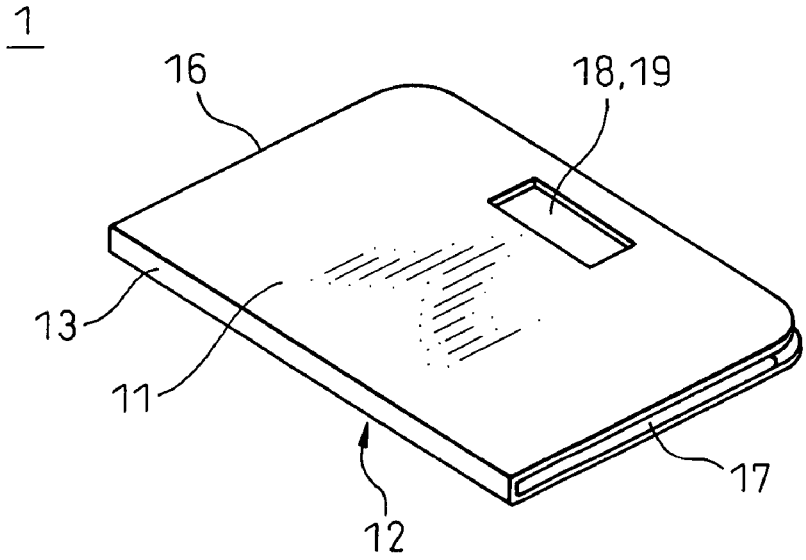
FIG. 2B is a perspective view showing the circuit board storage bag in closed state according to the invention.

The front surface portion 11 and the rear surface portion 12, therefore, are connected to each other through the first connecting portion 14, the bottom surface portion 13 and the second connecting portion 15. With the bending of the first connecting portion 14 and the second connecting portion 15, the front surface portion 11 and the rear surface portion 12 are bent at the connecting portions 14, 15, so that the circuit board storage bag 1 is closed as shown in FIG. 2B. The extension of the first connecting portion 14 and the second connecting portion 15, on the other hand, develops the front surface portion 11 and the rear surface portion 12 so that the circuit board storage bag 1 is opened as shown in FIG. 2A.

Figure 3:
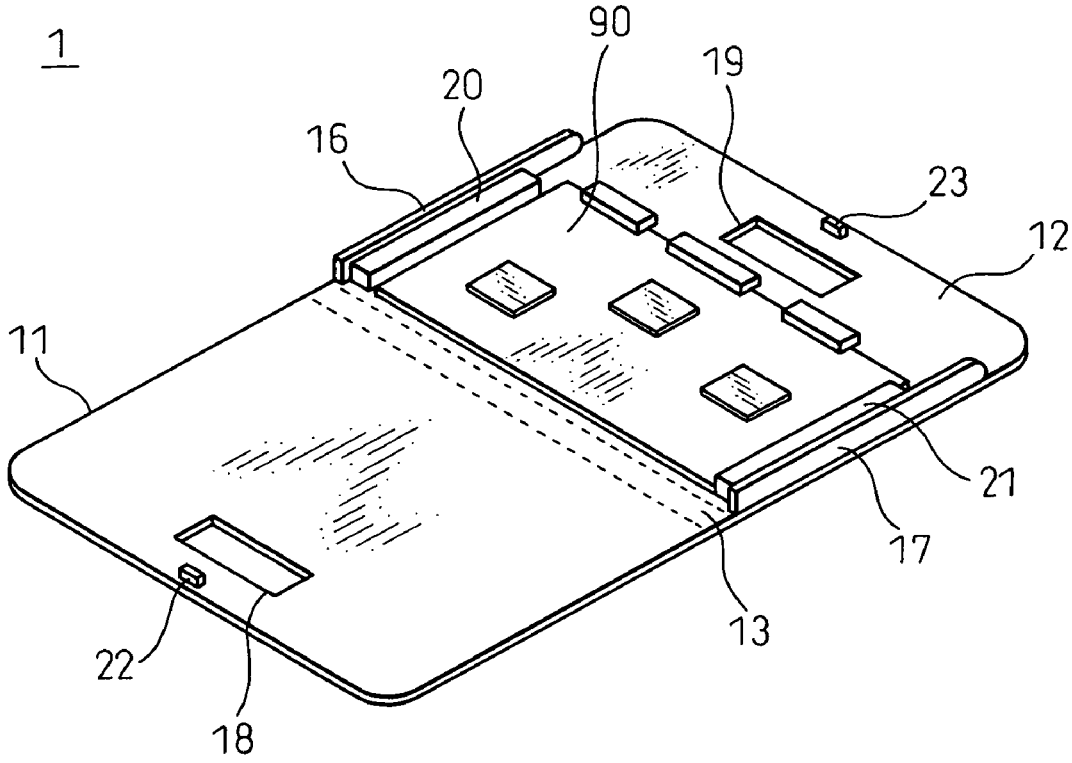
FIG. 3 is a diagram for explaining the manner in which printed circuit boards are accommodated in the circuit board storage bag according to the invention.

FIG. 3 is a diagram for explaining the manner in which a printed circuit board is accommodated in the circuit board storage bag according to the invention. As shown in FIG. 3, the printed circuit board 90 is accommodated with the obverse and reverse surfaces thereof in opposed relation to the front surface portion 11 and the rear surface portion 12, respectively, in the circuit board storage bag 1.

The front surface portion 11 and the rear surface portion 12 of the circuit board storage bag 1 in closed state, which are in opposed relation to the obverse surface and the reverse surface, respectively, of the printed circuit boards 9 accommodated therein are bent and develop thereby to open and close the bag 1. By employing the structure in which the front surface portion 11 and the rear surface portion 12 are opened and closed, the circuit board storage bag 1 is opened widely to facilitate the job of accommodating the printed circuit board 90. Also, even in the case where the printed circuit board 90 is accommodated with the mounted parts exposed, the mounted parts are not damaged by being caught at the time of inward or outward delivery.

The circuit board storage bag 1 may have circuit board guides 20, 21 to prevent the accommodated printed circuit board 90 from moving and provide a cushion against the shock of collision with the inner wall of the bag 1. Also, the circuit board storage bag 1 may have catches 18, 19 to facilitate the transportation. Further, the circuit board storage bag 1 may have front and rear fixing portions 22, 23 to maintain the closed state of the circuit board storage bag 1 by keeping the front surface portion 11 and the rear surface portion 12 fixed in closed state.

Figure 4A:
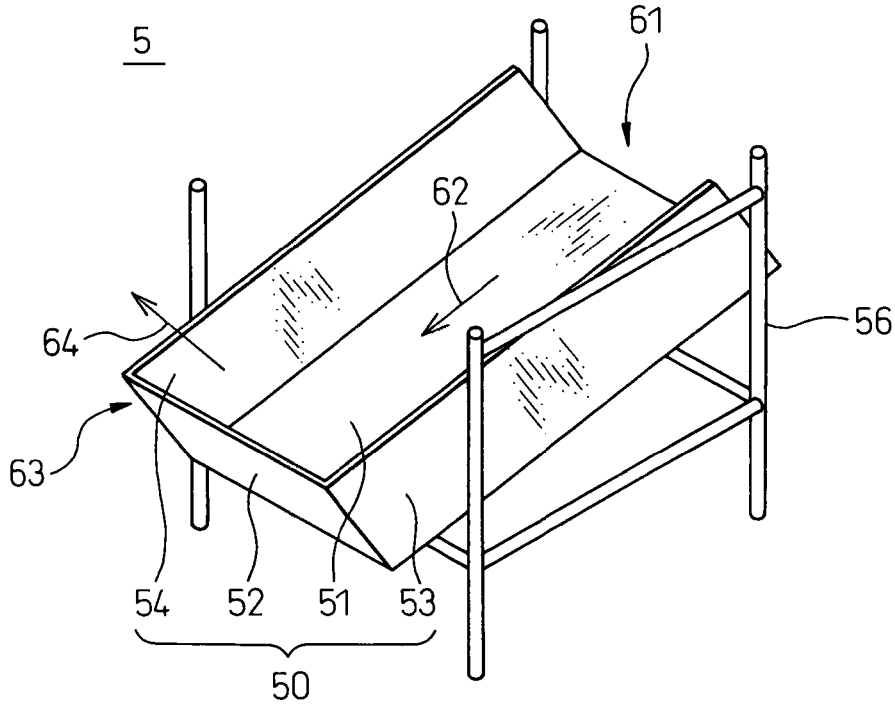
FIG. 4A is a perspective view showing the basic configuration of a storage rack according to the invention for accommodating the circuit board storage bags shown in FIG. 2A.

FIG. 4A is a perspective view showing the basic configuration of a storage rack to accommodate the circuit board storage bags 1 shown in FIG. 2A according to the invention. As shown in FIG. 4A, the storage rack 5 includes a bag storage 50 for accommodating the circuit board storage bags 1 and stems 56 on which to mount the bag storage 50.

The circuit board storage bags 1 accommodated in the storage rack 5 are placed on the upper surface of the bottom surface portion 51 of the bag storage 50. The upper surface of the bottom surface portion 51, therefore, makes up the mounting surface on which the circuit board storage bags 1 are placed. The upper surface of the bottom surface portion 51 is inclined at an angle to the floor surface on which the storage rack 5 is arranged. The circuit board storage bags 1 placed in vertical position in the bag storage 50, while sliding on the upper surface of the bottom surface portion 51 under their own weight, move down along the arrow 62 indicating the slope in FIG. 4A.

Further, the bag storage 50 includes a bag stopper 52 and bag guides 53, 54. The bag stopper 52 is arranged in the neighborhood of the lower end 63 of the inclined upper surface of the bottom surface portion 51, i.e. on the front surface of the bag storage 50 in such a manner that the circuit board storage bags 1 placed on the upper surface of the bottom surface portion 51 and moving along the slope 62 are stopped at the lower end 63 of the inclined upper surface and not fall off from the bottom surface portion 51.

The term "front" is used herein simply in connection with the fact that the bag stopper 52 is arranged forward in the direction 62 in which the circuit board storage bags 1 move along the upper surface slope of the bottom surface portion 51, and not intended to limit the direction in which the storage rack 5 is arranged. In similar fashion, the terms "rear" and "rear surface portion" used in connection with the storage rack 5 in the description that follows are used simply to indicate the direction in which the circuit board storage bags 1 move along the upper surface slope of the bottom surface portion 51 and are not intended to limit the direction in which the storage rack 5 is arranged.

Figure 4B:
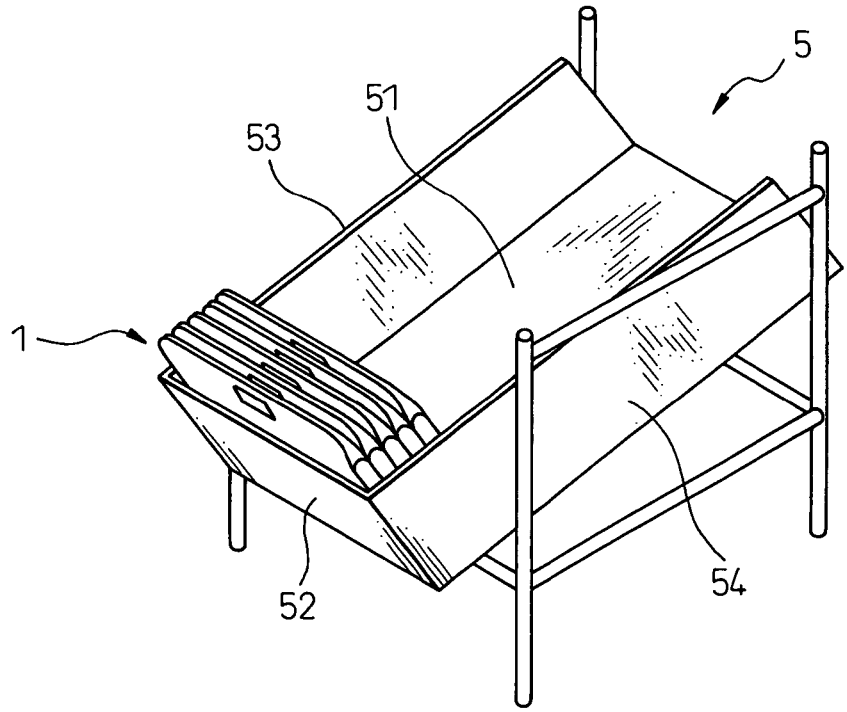
FIG. 4B is a diagram showing the circuit board storage bags mounted on the storage rack shown in FIG. 4A.

The circuit board storage bags 1 mounted on the bottom surface portion 51 are stopped at the lower end of the bottom surface portion 51 by the bag stopper 52 and accommodated on one side in the storage rack 5. FIG. 4B shows the state in which the circuit board storage bags 1 are mounted in the storage rack 5.

As shown in FIG. 4B, the circuit board storage bags 1 are oriented in such a position that the longitudinal direction, with the front surface portion 11 forward and the rear surface portion 12 rearward, is identical with the direction of the slope 62 on the upper surface of the bottom surface portion 51. At the same time, the circuit board storage bags 1 are mounted in vertical position (i.e. in the state in which the bottom surface portion 15 of the bags 1 is in contact with the bottom surface portion 51 of the storage rack 5, and the catches 18, 19 are up).

A plurality of the circuit board storage bags 1, accommodated in the storage rack 5, are stacked along the slope 62 on the upper surface of the bottom surface portion 51 of the storage rack 5.

Returning to FIG. 4A, the bag guides 53, 54 are arranged on the side surfaces along the slope 62 of the bag storage 50 to guide the circuit board storage bags 1 along the slope 62 on the upper surface of the bottom surface portion 51. The bag guides 53, 54 come into contact with the side surfaces 16, 17 of the circuit board storage bags 1 in store and thus prevent the circuit board storage bags 1 from falling from the sides of the bottom surface portion 51 off the direction of the slope 62.

The worker sets the bags 1, which accommodate the printed circuit boards 90 completed through the required process, in vertical position (i.e. with the catches 18, 19 up in FIG. 2B) from behind of the storage rack 5, i.e. on the upstream side 61, and accommodates by mounting them on the upper surface of the bottom surface portion 51 of the storage rack 5. The bags 1 mounted on the bottom surface 51 are moved forward (i.e. to the downstream side 63) under their own weight along the arrow 62 shown in FIG. 4, and are stopped by the bag stopper 52 and located on one side at the lower end 63 of the bottom surface portion 51.

In the case where a plurality of circuit board storage bags 1 are stored in the storage rack 5 as shown in FIG. 4B, therefore, the bag 1 first stored in the storage rack 5 is located at the foremost position (most downstream side) of the storage rack 5. The worker in charge of the next process takes out the circuit board storage bag 1 located at the foremost position in the direction along the arrow 64 shown in FIG. 4A. In this way, the plurality of the circuit board storage bags 1 stored in the storage rack 5 can be recovered chronologically, thereby facilitating the management on first-in first-out basis.

Figure 5:
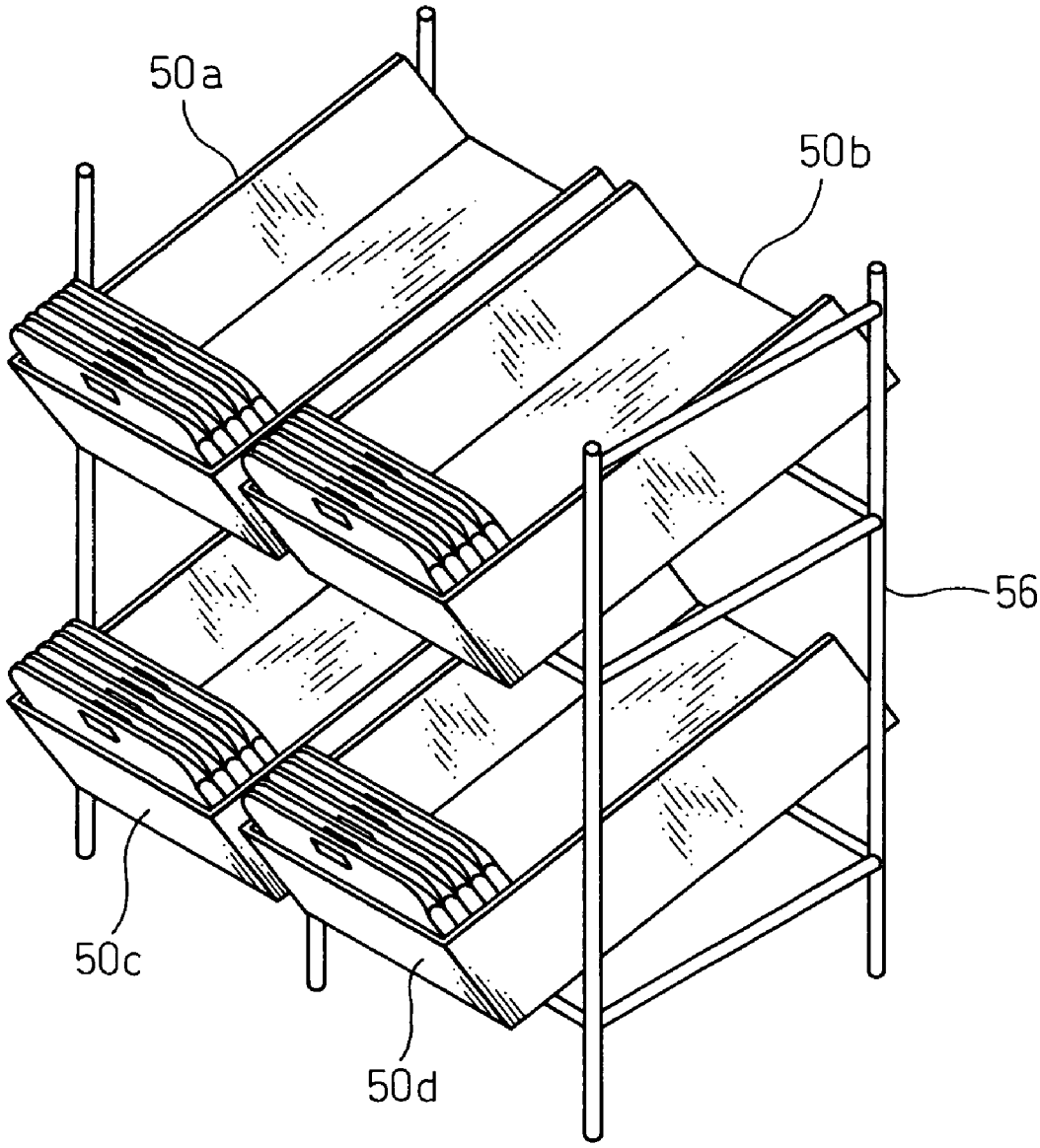
FIG. 5 is a diagram showing a plurality of the storage racks shown in FIG. 4A.

A plurality of the bag storages 50 in the storage rack 5 can be stacked and/or juxtaposed to permit a plurality of types of the printed circuit boards 90 to be stored by type, as shown in FIG. 5.

Figure 6:
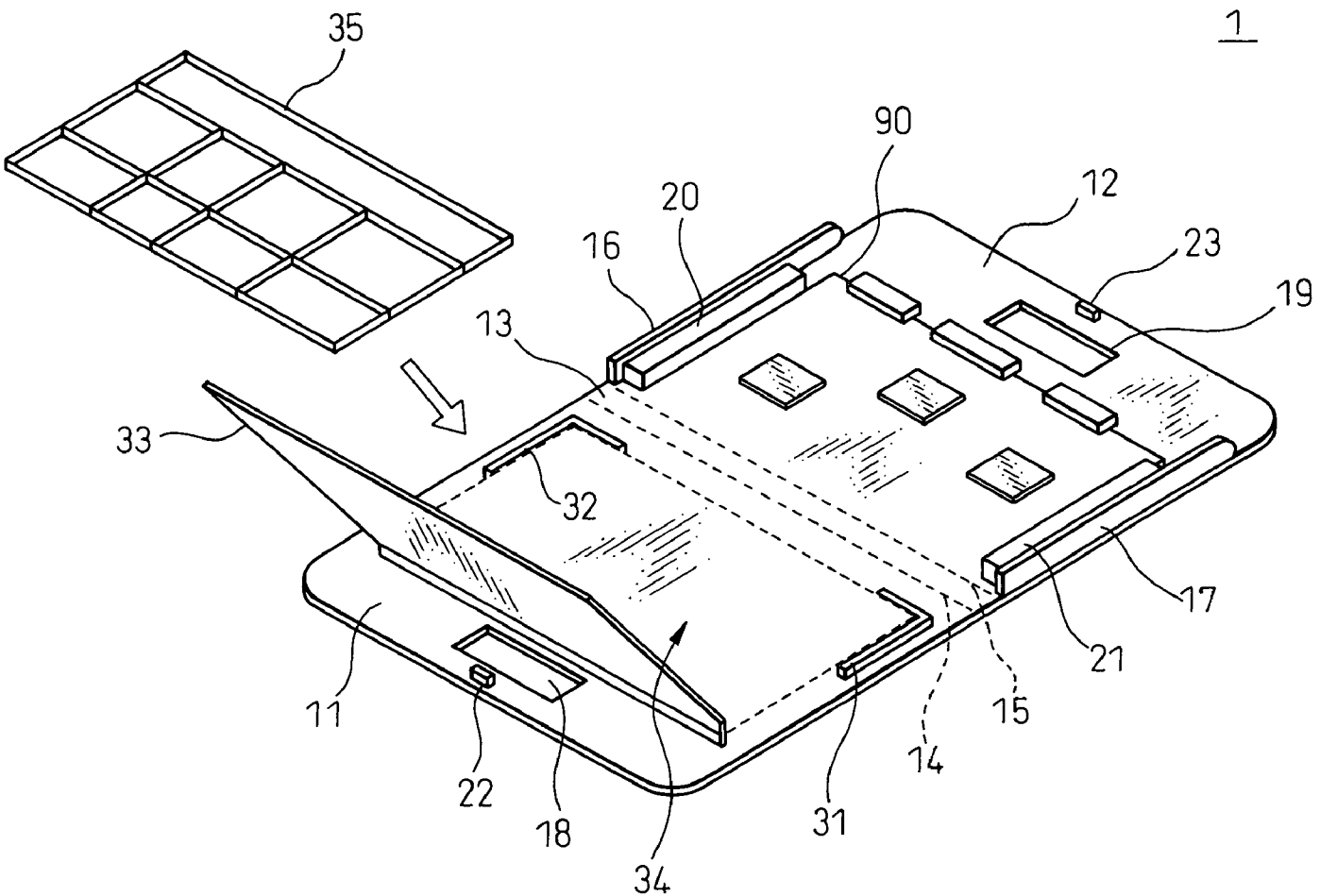
FIG. 6 is a perspective view showing the circuit board storage bag in open state according to an embodiment of the invention.

The circuit board storage bags according to preferred embodiments of the invention are described below with reference to the accompanying drawings. FIG. 6 is a perspective view of a circuit board storage bag in open state according to the invention.

As shown in FIG. 6, the circuit board storage bag 1 includes a front surface portion 11 making up the front surface of the bag 1 when in closed state, a rear surface portion 12 making up the rear surface of the bag 1, a bottom surface portion 13 making up the bottom surface of the bag 1, and side surface portions 16, 17 making up the side surfaces of the bag 1. The circuit board storage bag 1 is preferably formed of a material generating no static electricity, such as a plastic corrugated board generating no static electricity, to protect the circuit boards accommodated therein. Also, the front surface portion 11, the rear surface portion 12 and the bottom surface portion 13 may be formed integrally using the plastic corrugated board or the like.

The front surface portion 11 and the bottom surface portion 13 are connected to each other through a first connecting portion 14 adapted to bend. Similarly, the rear surface portion 12 and the bottom surface portion 13 are connected to each other through a second connecting portion 15 adapted to bend. The front surface portion 11 and the rear surface portion 12, therefore, are connected to each other through the first connecting portion 14, the bottom surface portion 13 and the second connecting portion 15.

In the case where the front surface portion 11, the rear surface portion 12 and the bottom surface portion 13 are formed integrally with each other, the bendable first connecting portion 14 and the bendable second connecting portion 15 may be formed as a first bend 14 adapted to bend in the boundary between the front surface portion 11 and the bottom surface portion 13 and a second bend 15 adapted to bend in the boundary between the rear surface portion 12 and the bottom surface portion 13, respectively. In the process, the front surface portion 11 and the rear surface portion 12 are connected to each other integrally through the first bend 14, the bottom surface portion 13 and the second bend 15.

Figure 7:
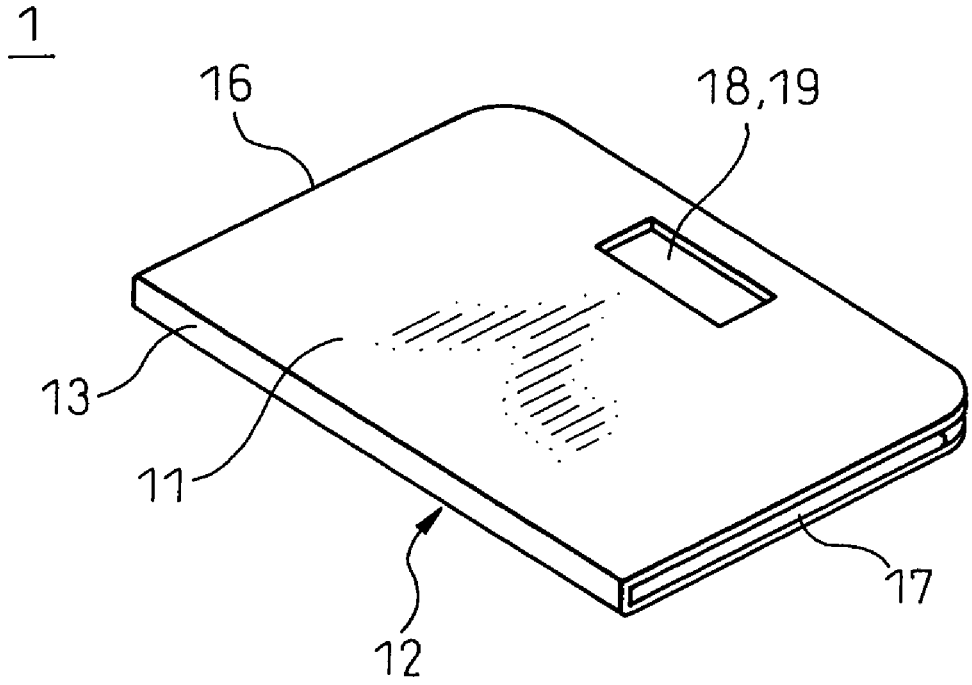
FIG. 7 is a perspective view showing the circuit board storage bag in closed state according to the embodiment shown in FIG. 6.

With the bending of the first connecting portion 14 and the second connecting portion 15, the front surface portion 11 and the rear surface portion 12 are bent at the connecting portions 14, 15, so that the circuit board storage bag 1 is closed as shown in FIG. 7. With the extension of the first connecting portion 14 and the second connecting portion 15, on the other hand, the front surface portion 11 and the rear surface portion 12 develop, with the result that the circuit board storage bag 1 is opened as shown in FIG. 6.

As shown in FIG. 6, the first connecting portion 14 and the second connecting portion 15 connect the front surface portion 11 and the rear surface portion 12 to each other in such a manner that as long as the circuit board storage bag 1 is open, the front surface portion 11 and the rear surface portion 12 assume a substantially flat surface in the same plane, i.e. the front surface portion 11 and the rear surface portion 12 are at an angle of 180° to each other.

As shown in FIG. 6, the printed circuit board 90 is accommodated in the closed circuit board storage bag 1 in such a manner that the obverse and reverse surfaces of the printed circuit board 90 are in opposed relation to the front surface portion 11 and the rear surface portion 12, respectively. By setting the front surface portion 11 and the rear surface portion 12 in a flat state as described above, the circuit board storage bag 1 is opened widely and thereby the job of accommodating the printed circuit board 90 becomes easy. Also, even in the case where the printed circuit board 90 is accommodated with the mounted parts in exposed state, the mounted parts are not damaged by being caught in the bag 1 while being put in or taken out.

Also, the circuit board storage bag 1, as in the basic configuration described above with reference to FIG. 2A, includes the circuit board guides 20, 21, the catches 18, 19 and the front and rear surface fixing portions 22, 23.

In the example shown in FIGS. 6 and 7, the catches are arranged as openings 18, 19 formed in the front surface portion 11 and the rear surface portion 12, respectively. Nevertheless, other structures may be employed.

Also, by forming the front and rear surface fixing portion 22, 23 of Magic Tape (registered trade mark), for example, the job of opening/closing the circuit board storage bag 1 is greatly facilitated.

Further, the circuit board storage bag 1 includes a part tray storage area 34 for accommodating a part tray 35 to accommodate the parts (the parts corresponding to one printed circuit board, for example) to be assembled on the printed circuit board 90 in the fabrication process. Thus, the printed circuit board 90 and the mounting parts assembled on it can be transported at the same time in the fabrication process.

In the case of FIG. 6, for example, the part tray 35 is accommodated in the part tray storage area 34 defined by part tray guides 31, 32 and a part tray cover 33 on the reverse surface of the front surface portion 11 in the circuit board storage bag 1, and the part tray cover 33 prevents the scattering of the parts stored in the part tray 35. Also, the number of partitions and types of the tray 35 can set freely in accordance with the size, shape and type of the parts used on the printed circuit board 90.

The method of operating the circuit board storage bag 1 using the part tray 35 is explained later.

Figure 8A:
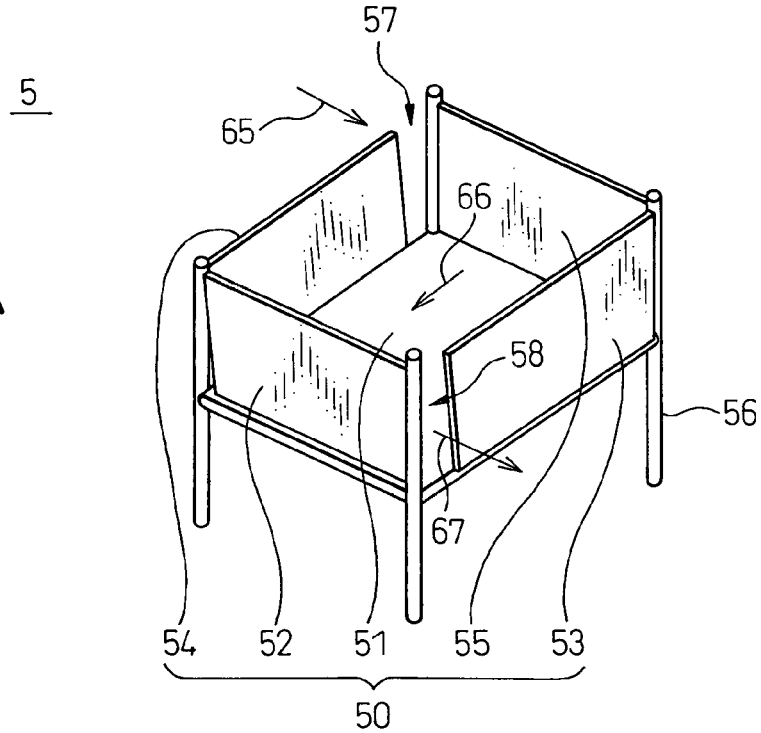
FIG. 8A is a perspective view showing the storage rack according to an embodiment of the invention.

FIG. 8A is a perspective view showing a storage rack according to an embodiment of the invention for storing the circuit board storage bags 1 described above. As shown in FIG. 8A, the storage rack 5 includes a bag storage 50 for accommodating the circuit board storage bags 1 and stems 56 on which the bag storage 50 is mounted.

The circuit board storage bags 1 accommodated in the storage rack 5 are arranged on the upper surface of the bottom surface portion 51 of the bag storage 50. The upper surface of the bottom surface portion 51 is inclined at an angle to the floor surface on which the storage rack 5 is installed. The circuit board storage bags 1 placed in vertical position in the bag storage 50, while sliding over the upper surface of the bottom surface portion 51 under their own weight, move down on the slope along the arrow 66 shown in FIG. 8A.

Further, the bag storage 50 includes a bag stopper 52 and bag guides 53, 54. The bag stopper 52 is arranged in the neighborhood of the lower end of the inclined upper surface of the bottom surface portion 51, i.e. on the front surface of the bag storage 50 so that the circuit board storage bags 1 placed on the upper surface of the bottom surface portion 51 and moving along the slope 66 over the surface of the upper surface of the bottom surface portion 51 may be stopped at the lower end of the inclined upper surface and not fall off from the bottom surface portion 51.

Figure 8B:
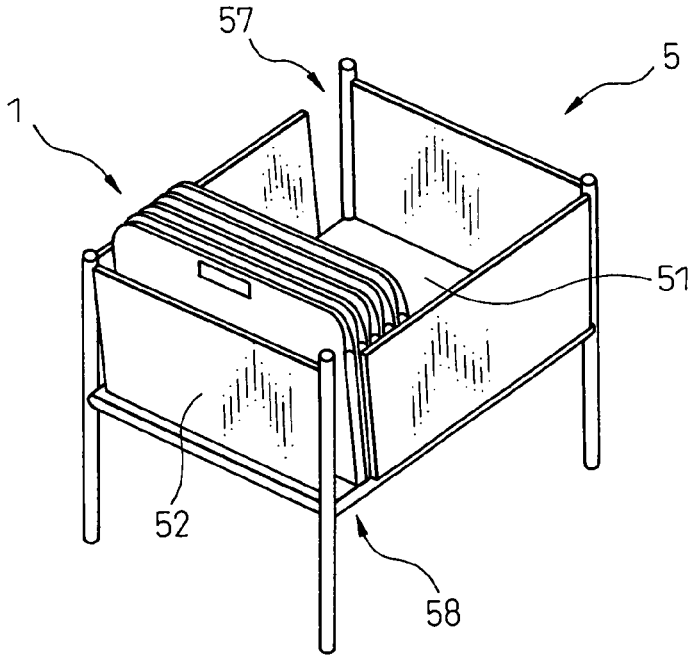
FIG. 8B is a diagram showing the state in which the circuit board storage bags are mounted in the storage rack shown in FIG. 8A.

The circuit board storage bags 1 placed on the bottom surface portion 51 are stopped at the lower end of the bottom surface portion 51 by the bag stopper 52 and stored on one side in the storage rack 5. FIG. 8B shows the state in which the circuit board storage bags 1 are mounted in the storage rack 5.

As shown in FIG. 8B, the circuit board storage bags 1 are oriented in such a position that the longitudinal direction with the front surface portion 11 forward and the rear surface portion 12 backward coincides with the direction of the slope 66 on the upper surface of the bottom surface portion 51. In addition, the circuit board storage bags 1 are set in vertical position (i.e. in the state in which the bottom surface portion 15 of the bags 1 is in contact with the bottom surface portion 51 of the storage rack 5, and the catches 18, 19 up).

A plurality of the circuit board storage bags 1, if accommodated in the storage rack 5, are stacked in the direction of slope 66 on the upper surface of the bottom surface portion 51 of the storage rack 5.

Returning to FIG. 8A, the bag guides 53, 54 are arranged on the side surfaces along the slope 66 of the bag storage 50 to guide the circuit board storage bags 1 along the slope 66 on the upper surface of the bottom surface portion 51. The bag guides 53, 54, in contact with the side surface portions 16, 17 of the stored circuit board storage bags 1, prevent the circuit board storage bags 1 from fall off from the side of the bottom surface portion 51 off the direction of the slope 66.

Also, a rear surface portion 55 is arranged on the rear side surface corresponding to the front side surface of the bag storage 50 on which the bag stopper 52 is arranged.

An inward delivery port 57 for introducing the circuit board storage bags 1 into the storage rack 5 is arranged backward of the bag storage 50, i.e. upstream of the slope 66 on the upper surface of the bottom surface portion 51. Similarly, an outward delivery port 58 to recover the circuit board storage bags 1 from the storage rack 5 is arranged forward of the bag storage 50, i.e. downstream of the slope 66.

The inward delivery port 57 and the outward delivery port 58 are set preferably to a opening size slightly larger than the thickness of a single circuit board storage bag to permit the circuit board storage bags 1 to be recovered one at a time. The structure is such that an attempt to recover the circuit board storage bags 1 from other than the outward delivery port 58 would substantially fail by the interference of the bag stopper 52, the bag guides 53, 54 and the rear surface portion 55. As a result, any intermediate one of the plurality of the circuit board storage bags 1 stacked in the storage rack 5 cannot be easily recovered and therefore the management on first-in first-out basis can be easily assured.

Also, as shown in FIG. 8A, the inward delivery port 57 and the outward delivery port 58 have an opening formed in the direction perpendicular to the direction of the slope 66 on the upper surface of the bottom surface portion 51 in which the circuit board storage bags 1 are stacked. As a result, the size of the storage rack 5 in the direction in which the circuit board storage bags 1 are recovered can be maintained constant regardless of the allowable number of the circuit board storage bags 1 stored. Thus, this structure is effectively applicable in the case where the installation space of the storage rack 5 is limited.

Further, as shown in FIG. 8A, the opening of the inward delivery port 57 and the outward delivery port 58 are formed in the direction perpendicular to the direction 66 in which the circuit board storage bags 1 are stored in stack. At the same time, the two openings are arranged in opposite directions while setting the same inward delivery direction 65 as the outward delivery direction 67. As a result, the distance between the inward delivery port 57 and the outward delivery port 58 can be kept constant. This is effectively applicable in the case where the storage rack 5 is arranged between a given process line and the subsequent process line.

Each bag 1 accommodating the printed circuit board 90 having completed the present process is inserted in vertical position by the worker into the inward delivery port 57 on the upstream side of the storage rack 5 along the direction of arrow 65, and stored by being mounted on the bottom surface portion 51 of the storage rack 5. The bag 1 mounted on the bottom surface portion 51, after moving along arrow 66 forward (toward the downstream side) by its own weight, is stopped by the bag stopper 52 into the state located on one side at the lower end of the bottom surface portion 51.

In this way, a plurality of the circuit board storage bags 1 are stacked from the foremost position (most downstream position) of the storage rack 5 in chronological order in the storage rack 5. The circuit board storage bag 1 located at the foremost position of the storage rack 5 is recovered by the worker in charge of the next process along the direction of arrow 67 from the outward delivery port 58 formed on the downstream side of the storage rack 5. Thus, the bag 1 first stored in the storage rack 5 is recovered.

Figure 9:
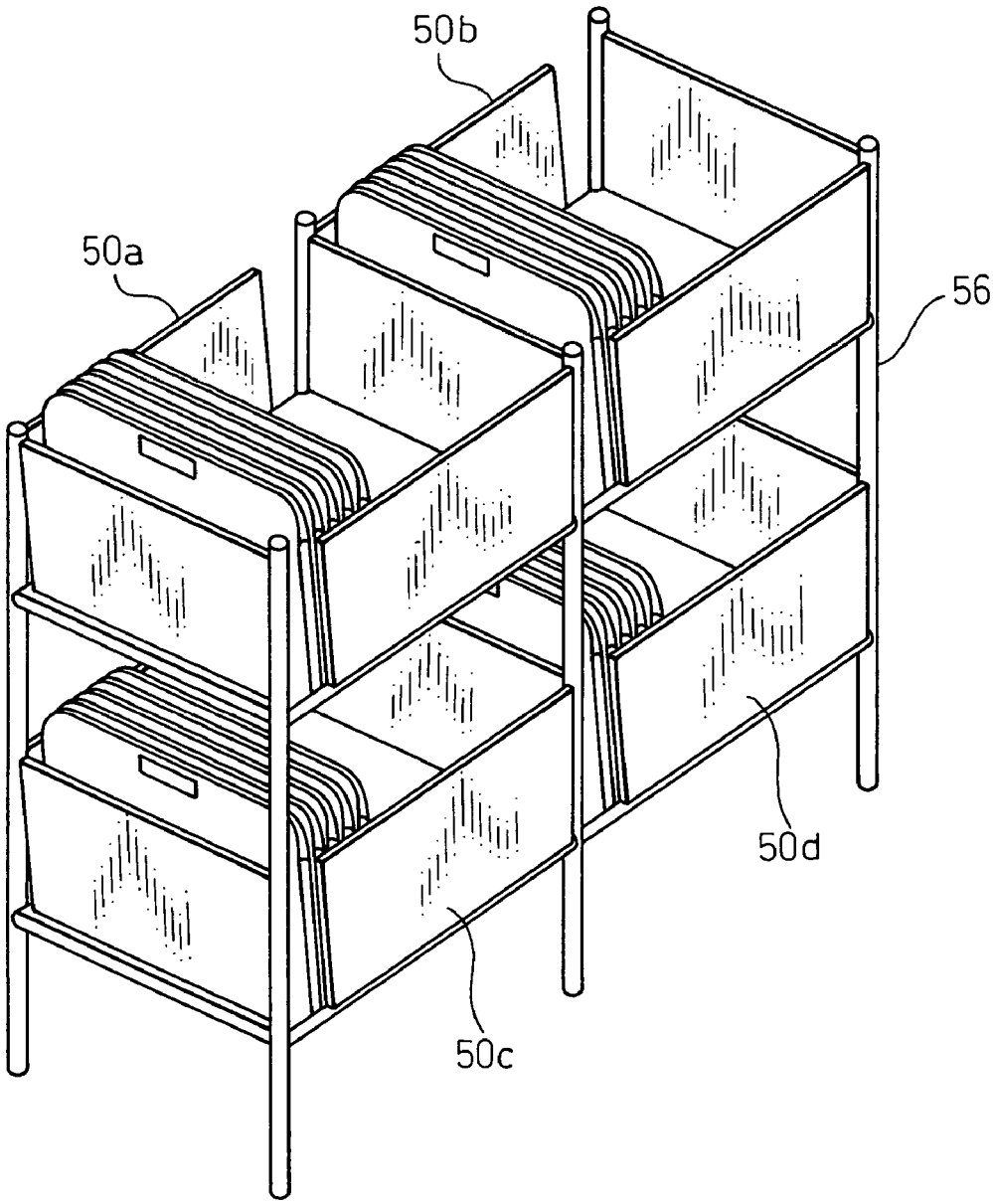
FIG. 9 is a diagram showing the state in which a plurality of storage racks shown in FIG. 8A are arranged.

A plurality of the bag storage 50 of the storage rack 5 may be stacked and/or juxtaposed to meet the type requirement of the printed circuit board 90, as shown in FIG. 9.

An example of the method of using the circuit board storage bag 1 and the storage rack 5 on the production line according to an embodiment of the invention is explained with reference to FIG. 10.

Figure 10:
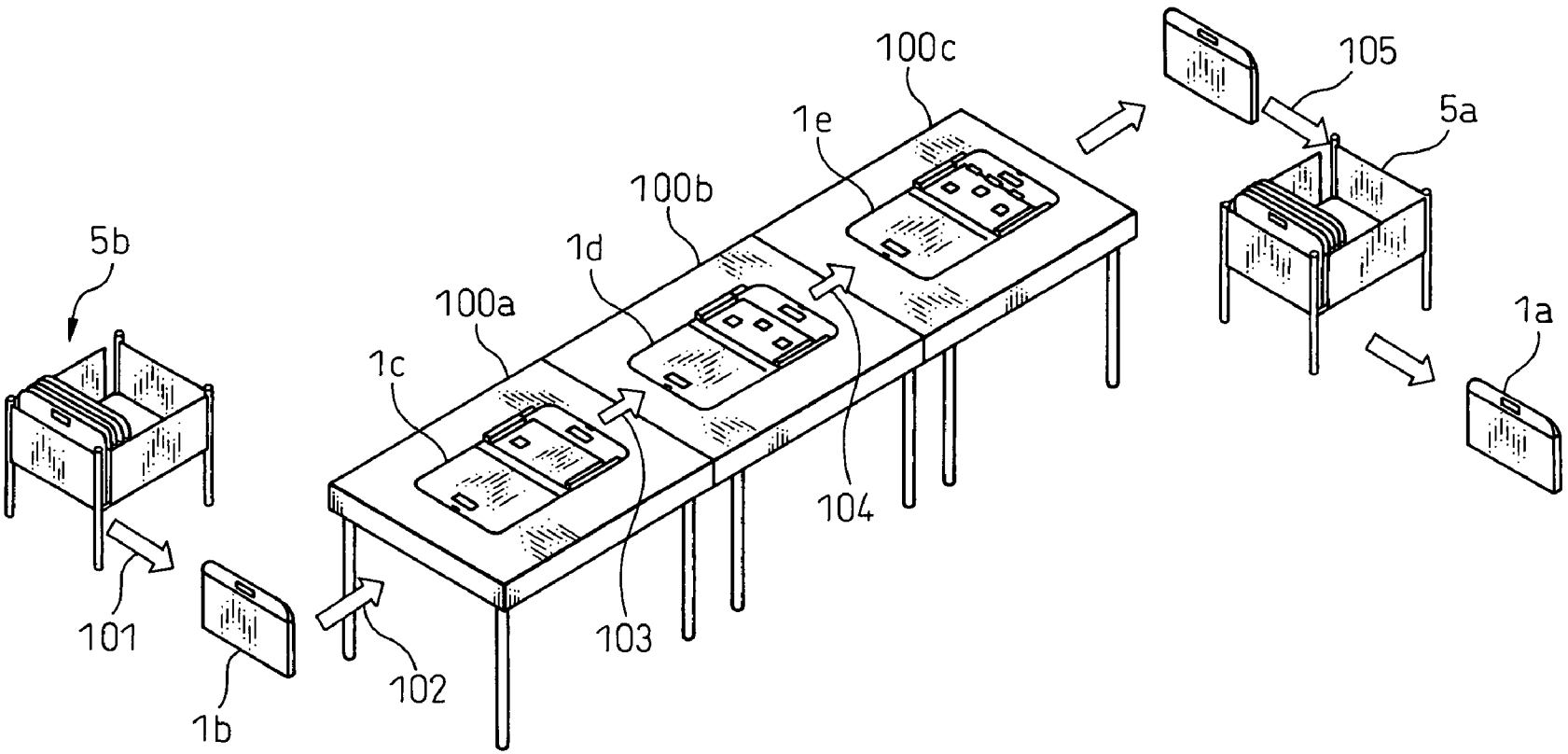
FIG. 10 is a diagram for explaining an example of the method of using the circuit board storage bag and the storage rack according to an embodiment of the invention.

In the production line shown in FIG. 10, a series of jobs 1, 2, 3 making up the production line are performed on work benches 100*a*, 100*b*, 100*c*, respectively. Each production line includes storage racks 5*a*, 5*b* called the "store" to store the products to be assembled or completely assembled on the particular line. In the case shown in FIG. 10, a storage rack 5*b* for the preceding process and a storage rack 5*a* for the present process are arranged at the starting point and the finish point of the production line. As explained with reference to FIG. 9, however, a plurality of storage racks may be arranged to store a plurality of products by type.

The production line is operated in the manner described below.

First, one bag 1*a* containing the product is recovered from the store 5*a* for the present process, and based on the information thereof, a bag 1*b* is taken out of the store 5*b* for the preceding process as indicated by arrow 101 in FIG. 10, and charged into the production line as indicated by arrow 102.

Next, the bag 1*c* charged is opened and the assigned job, i.e. job 1 is carried out on the work bench 100*a*. In the process, as explained with reference to FIG. 6A, the bag 1 is opened into a flat state and therefore acts as a conveyor tray for transporting each product between different jobs in a production line. The worker, upon completion of job 1, transfers the bag 1*c* with the product to the next job 2 (arrow 103).

On the work bench 100*b* for job 2, the worker receives the open bag id with the product from the work bench 100*a* of the preceding job, and conducts the assigned job. Upon completion of the job, the bag 1*d* is transferred to the next job 3 with the product (arrow 104).

Upon complete assembly work at the last job 3, the bag 1*e* is closed and contains the product. Under this condition, the product is stored in the store 5*a* for the present process (arrow 105).

By use of the bag 1 according to this invention as described above, as many jobs as required by a process can be received, one by one, from the preceding process. In this way, the job of putting and taking the printed circuit board in and out of the container used in the prior art can be eliminated.

The method of operating the part tray 35 described with reference to FIG. 6 is explained below.

The printed circuit board 90 completed in the preceding process (the primary assembly process making up, for example, a SMT assembly process) is accommodated in the store (storage rack 5) after being stored in the circuit board storage bag 1. The printed circuit board 90 accommodated in the bag 1 is transferred with the bag 1 by the conveyor from the store of the primary assembly process whenever the job of the next process (the secondary assembly process making up, for example, the IMT assembly process) is required.

While recovering the bag 1 from the store of the preceding process, the conveyor drops by a part rack and picks up the parts required for the assembly of the corresponding printed circuit board 90. The conveyor then puts it in the part tray 35, applies the cover and thus stores the printed circuit board in the bag. After that, the bag is charged into the next process (secondary assembly process). When the bag 1 is opened in the next process, the printed circuit board 90 and all the parts required for the assembly are available, and therefore the assembly work can be started immediately. Upon completion of the secondary assembly, the part tray 35 becomes unnecessary and therefore is removed from the bag 1. Then, only the printed circuit board 90 is put into the bag 1, and the bag 1 is closed and accommodated in the store for the present process.

As described above, in the case where the printed circuit board 90 is accommodated and transported in the circuit board storage bag 1, the parts required for the assembly of the printed circuit board 90 can also be transported in the part tray 35 incorporated therein. In this way, the labor of distributing the parts to each process and preparing a stock of the parts in each process can be saved.

As explained with reference to FIG. 8B, each circuit board storage bag 1 is mounted in the storage rack 5 in vertical position (i.e. with the bottom surface portion 15 of the bag 1 in contact with the bottom surface portion 51 of the storage rack 5, and the catches 18, 19 up), and moved forward while sliding on the inclined mounting surface of the storage rack 5 by own weight.

On the other hand, the circuit board storage bag 1 has the front surface 11 and the rear surface 12 in opposed relation to the obverse surface and the reverse surface, respectively, of the circuit board 90 stored therein. Generally, therefore, the front surface 11 and the rear surface 12 have a larger area than the other portions, and the circuit board storage bag 1 assumes a thin form. The circuit board storage bag 1 in this shape moving in vertical position in the storage rack 5 is liable to fall and jam the storage rack 5.

Figure 11A:
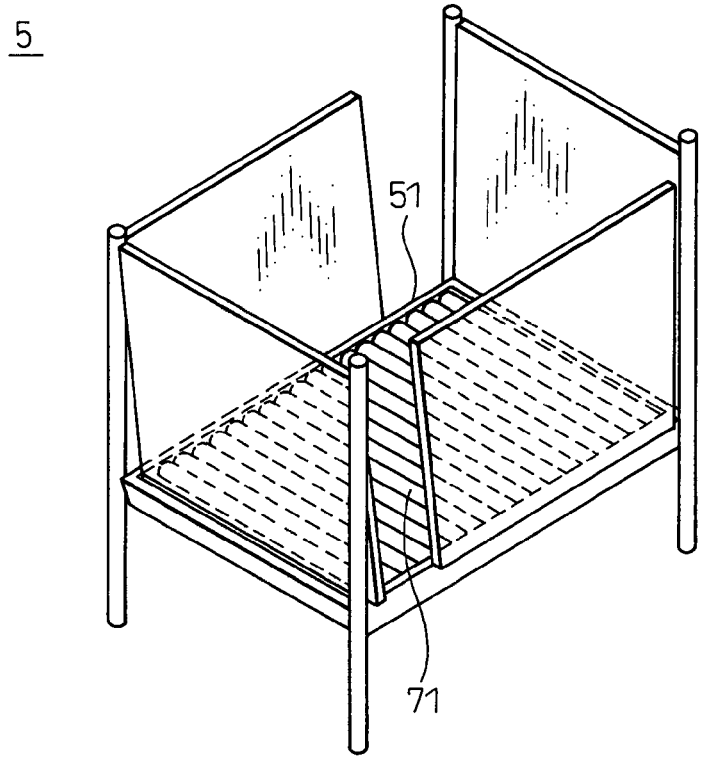
FIG. 11A is a perspective view of the storage rack having a first example of an anti-fall portion for the circuit board storage bag.
Figure 11B:
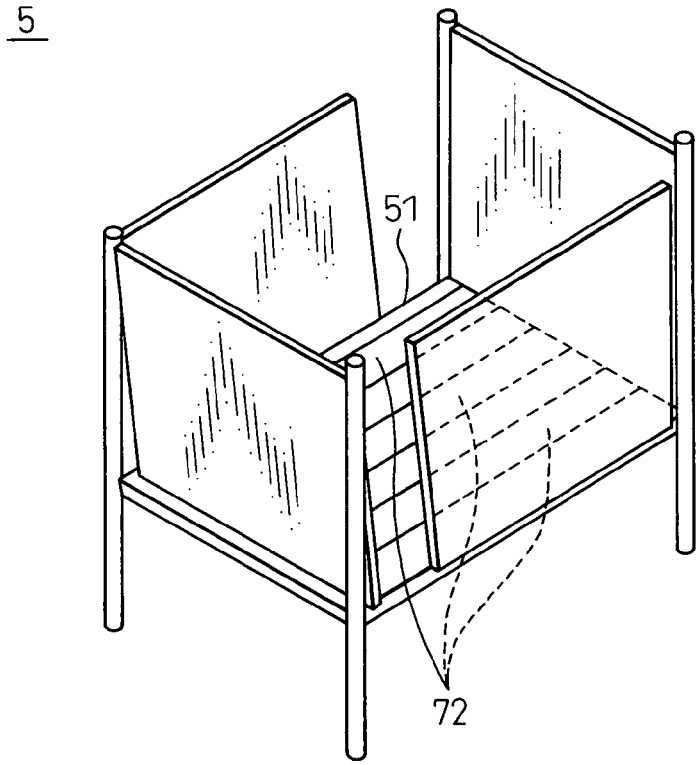
FIG. 11B is a perspective view of the storage rack having a second example of an anti-fall portion for the circuit board storage bag.

In order to prevent the circuit board storage bag 1 from falling, the storage rack shown in FIGS. 11A, 11B is equipped with, as an anti-fall unit, moving resistance reducers 71, 72 to reduce the moving resistance of the circuit board storage bag 1 moving over the upper surface of the bottom surface portion 51 of the storage rack 5. As a specific example, the storage rack 5 shown in FIG. 11A has a roller conveyor 71 on the upper surface of the bottom surface portion 51 to reduce the moving resistance of the circuit board storage bag 1, while the storage rack 5 shown in FIG. 11B has sill slips 72 on the upper surface of the bottom surface portion 51 to reduce the moving resistance of the circuit board storage bag 1.

By reducing the moving resistance of the circuit board storage bag 1, the friction between the bottom surface 13 of the circuit board storage bag 1 and the upper surface of the bottom surface portion 51 of the storage rack 5 is reduced. As a result, the circuit board storage bag 1 is less likely to tilt forward and can be prevented from falling.

Figure 12A:
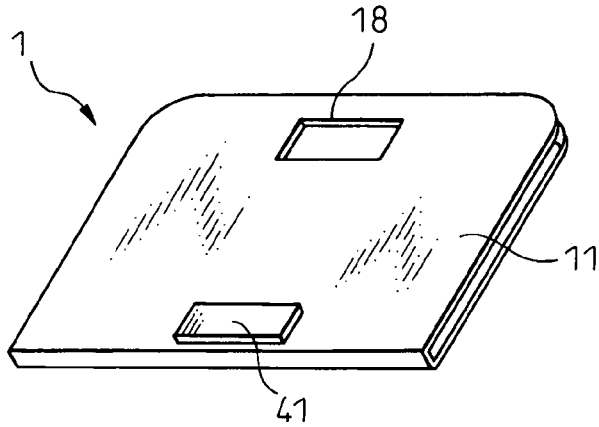
FIG. 12A is a perspective view showing the front surface of the circuit board storage bag having a third example of an anti-fall portion.
Figure 12B:
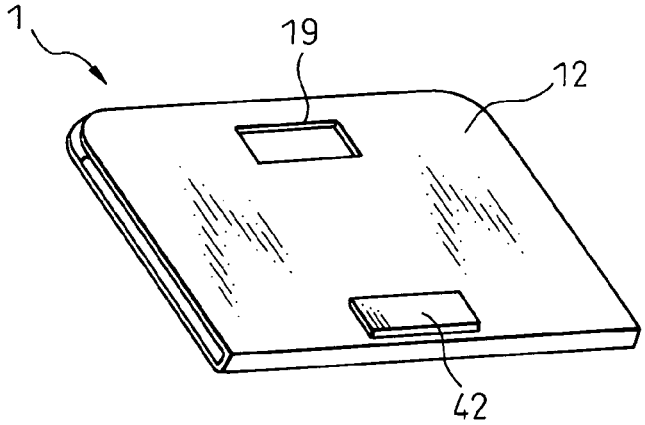
FIG. 12B is a perspective view showing the rear surface of the circuit board storage bag having the third example of the anti-fall portion.

FIG. 12A is a perspective view showing the front surface of the circuit board storage bag having a third example of the anti-fall unit, and FIG. 12B a perspective view showing the rear surface of the storage bag 1 of FIG. 12A. The circuit board storage bag 1 has magnets 41, 42 on the front surface portion 11 and the rear surface portion 12 to connect the circuit board storage bags 1 to each other.

Figure 12C:
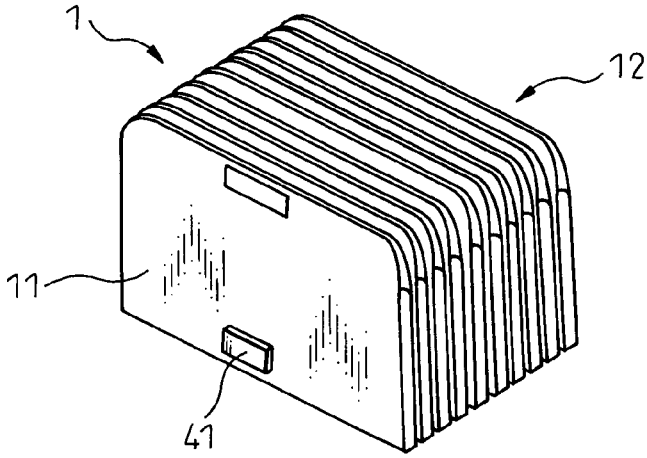
FIG. 12C is a perspective view showing the circuit board storage bags of FIG. 12A arranged in juxtaposed relation.

Using this circuit board storage bag connector, one of the front surface and the rear surface of one circuit board storage bag 1 is brought into contact with one of the front surface and the rear surface of another circuit board storage bag 1 and thus the two circuit board storage bags are connected to each other. The circuit board storage bags 1 stacked in the storage rack 5 are thus connected to each other and prevented from falling, as shown in FIG. 12C.

Figure 13A:
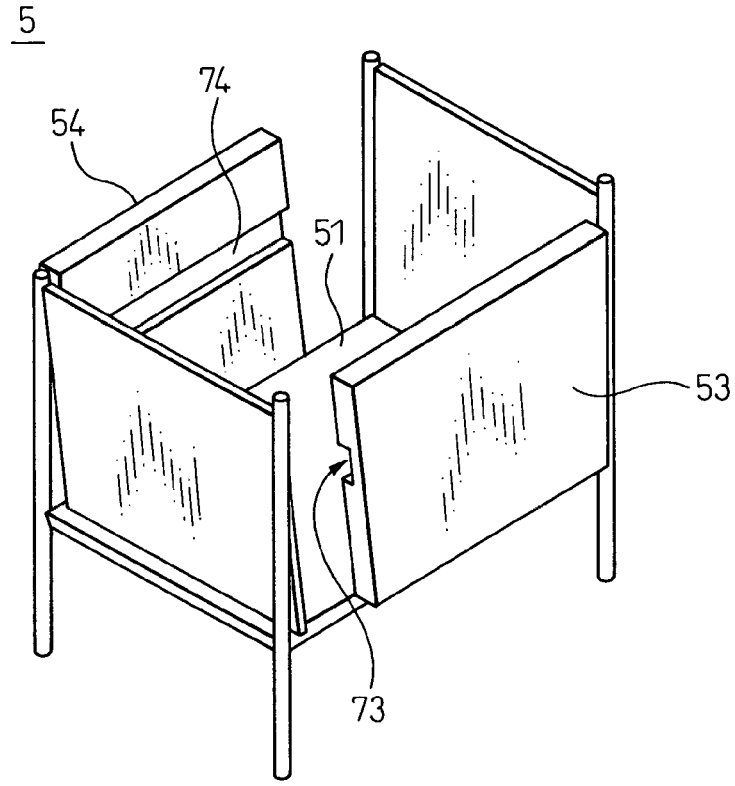
FIG. 13A is a perspective view of a storage rack having a fourth example of the anti-fall portion.
Figure 13B:
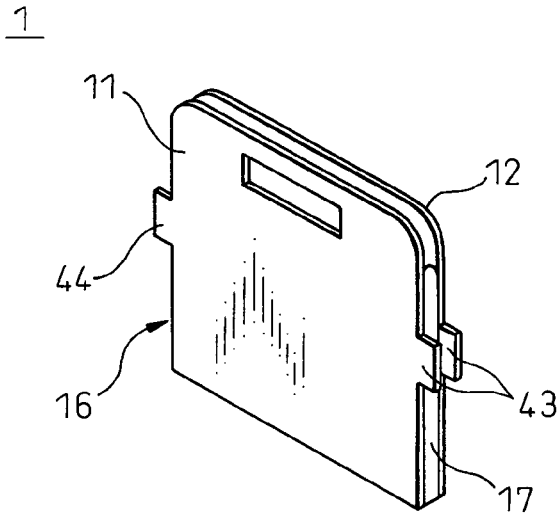
FIG. 13B is a perspective view showing the circuit board storage bag used with the storage rack shown in FIG. 13A.

FIG. 13A is a perspective view showing the storage rack having a fourth example of the anti-fall means, and FIG. 13B a perspective view showing the circuit board storage bag used with the storage rack shown in FIG. 13A.

The bag guides 53, 54 of the storage rack 5 are in contact with the side surfaces 16, 17 of the circuit board storage bags 1 accommodated in the storage rack 5. The bag guides 53, 54 are formed with guide grooves 73, 74 along the upper surface slope of the bottom surface portion 51, and the side surfaces 16, 17 of the circuit board storage bag 1 have protrusions 43, 44 adapted to engage the guide grooves 74, 73, respectively.

The guide grooves 73, 74 have a margin of an appropriate size with respect to the width of the protrusions 43, 44. Thus, the circuit board storage bags 1 that are almost falling are prevented from falling by the protrusions 43, 44 coming into contact with the inner surface of the guide grooves 73, 74.

In the case of FIG. 13B, the protrusions 44, 43 are formed on the edges of the front surface portion 11 and the rear surface portion 12. These protrusions may alternatively be formed directly on the side surfaces 16, 17 of the circuit board storage bag 1.

In the case of FIGS. 13A, 13B, on the other hand, the recessed guide grooves 73, 74 are formed on the bag guides 53, 54, while the protrusions 43, 44 are formed from the sides 16, 17 of the circuit board storage bag 1. On the contrary, however, a bank may be formed on each of the bag guides 53, 54, and recesses adapted to engage the banks may be formed on the sides 16, 17 of the circuit board storage bag 1.

By transporting the printed circuit boards one by one using the circuit board storage bag according to the invention, the stock in process can be reduced. Thus, the inventory is reduced, and the product lead time can be shortened. Also, the space for installation of the products in process can be saved.

Further, the employment of a bag structure with the front surface portion and the rear surface portion thereof adapted to be widely opened and closed facilitates the job of accommodating the circuit boards and prevents the mounted parts from being damaged while being put in or taken out.

The storage rack according to the invention makes it easy to put and take the printed circuit board in and out of stock, which in turn facilitates the product management on first-in first-out basis.

This invention is applicable to a storage bag used to accommodate and transport an electrical device, an electrical circuit board for the electrical device or an electronic circuit board for the electronic device. Especially, the invention finds a suitable application as a storage bag used to accommodate and transport the electrical and electronic circuit boards between the processes for fabrication or test of electrical and electronic devices.

While the invention has been described with reference to specific embodiments chosen for purposes of illustration, it should be apparent that numerous modifications could be made thereto, by those skilled in the art, without departing from the basic concept and scope of the invention.

What is claimed is:

1. A storage rack for mounting a plurality of circuit board storage bags, the storage rack comprising:

an inclined mounting surface for mounting the circuit board storage bag and a bag stopper arranged at the lower end of the mounting surface;

wherein the circuit board storage bags mounted in vertical position on the mounting surface are accommodated on one side at the lower end of the mounting surface;

an inward delivery port for receiving the circuit board storage bags from the upstream side of the inclined mounting surface and an outward delivery port for recovering the circuit board storage bags from the downstream side of the mounting surface, and wherein the circuit board storage bag for accommodating a circuit board comprises:

a front surface portion and a rear surface portion in opposed relation to the obverse surface and the reverse surface, respectively, of the circuit board accommodated in the circuit board storage bag in closed state; and a connecting portion for connecting the front surface portion and the rear surface portion adapted to bend at the connecting portion thereby to close the circuit board storage bag.

2. The storage rack for mounting a plurality of circuit board storage bags of claim 1, wherein the connecting portion of the storage bag connects the front surface portion and the rear surface portion to each other in such a manner that the front surface portion and the rear surface portion form a flat surface of the circuit board storage bag in open state.

3. The storage rack for mounting a plurality of circuit board storage bags of claim 1, wherein the storage bags further comprise an anti-fall unit for preventing the circuit board storage bag, which is mounted in vertical position on a slope in contact with the surfaces other than the front and rear surfaces thereof, from falling due to the inclination of the slope.

4. A storage rack according to claim 1, comprising a moving resistance reducer arranged on the mounting surface to reduce the moving resistance of the circuit board storage bags moving on the mounting surface.

5. A storage rack according to claim 1, comprising an anti-fall unit for preventing the circuit board storage bags from falling due to the inclination of the mounting surface.

6. A storage rack for mounting circuit board storage bags, wherein a plurality of the circuit board storage bags are stored by being stacked in a predetermined direction;

the storage rack comprising an inward delivery port open in the direction perpendicular to the predetermined direction to receive the circuit board storage bags and an outward delivery port open in the direction perpendicular to the predetermined direction to recover the circuit board storage bags, and wherein the circuit board storage bags for accommodating a circuit board comprise:

a front surface portion and a rear surface portion in opposed relation to the obverse surface and the reverse surface, respectively, of the circuit board accommodated in the circuit board storage bag in closed state; and a connecting portion for connecting the front surface portion and the rear surface portion adapted to bend at the connecting portion thereby to close the circuit board storage bag.

* * * * *